US006194989B1

(12) United States Patent
Douglass

(10) Patent No.: US 6,194,989 B1
(45) **Date of Patent: *Feb. 27, 2001**

(54) FUSE ELEMENT HAVING PARALLEL STRIPS

(75) Inventor: Robert S. Douglass, St. Louis, MO (US)

(73) Assignee: Cooper Technologies Company, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/313,769

(22) Filed: May 18, 1999

Related U.S. Application Data

(60) Continuation-in-part of application No. 09/004,443, filed on Jan. 8, 1998, now Pat. No. 5,905,426, which is a division of application No. 08/670,559, filed on Jun. 27, 1996, now Pat. No. 5,736,918.

(51) Int. Cl.[7] ..... H01H 85/12; H01H 85/143

(52) U.S. Cl. ..... 337/229; 337/228; 337/231; 337/233; 337/260; 337/293; 337/295

(58) Field of Search ..... 337/227, 278, 337/186, 161, 164, 180, 181, 229, 290–295, 159, 231, 233, 236, 260; 29/623

(56) References Cited

U.S. PATENT DOCUMENTS 3,743,994 * 7/1973 Kozacka ..... 337/159
4,153,892 * 5/1979 Kozacka ..... 337/159
4,179,678 * 12/1979 Perreault ..... 337/293
4,319,213 * 3/1982 Reid ..... 337/161
5,077,534 * 12/1991 Douglass ..... 337/164
5,736,918 * 4/1998 Douglass ..... 337/186
5,905,426 * 5/1999 Douglas ..... 337/229

* cited by examiner

*Primary Examiner*—Leo P. Picard
*Assistant Examiner*—Anatoly Vortman
(74) *Attorney, Agent, or Firm*—Armstrong Teasdale LLP

(57) ABSTRACT

A fuse includes a tube, a pair of blade terminals projecting from opposite ends of the tube, at least one fuse element disposed in the tube and electrically coupled between the terminals, and a pair of metallic end caps disposed on opposite ends of the tube. Electrically insulative elements are disposed between the end caps and the terminals. The tube is filled with an arc-quenching material inserted through a fill hole that is plugged by a plastic drive rivet. Each terminal is attached to a metallic end plate by means of a staking tang inserted into a slot of the end plate, and by means of a separate solder joint. Each insulative element includes an axial sleeve through which a respective terminal extends for a part of its length. The fuse element comprises a one-piece metal element bent to form a pair of parallel, superimposed strips divided into sections by means of fusible weak points. The metal element also includes bridge elements which join sections of one strip to respective sections of the other strip, the bridges themselves being non-interconnected. End-most sections of one strip are fixedly joined to respective end-most sections of the other strip to define tabs for electrically connecting the fuse element to a circuit.

6 Claims, 12 Drawing Sheets

FUSE ELEMENT HAVING PARALLEL STRIPS

CROSS-REFERENCE TO RELATED APPLICATIONS

The present application is a continuation-in-part of U.S. patent application Ser. No. 09/004,443, filed on Jan. 8, 1998, now U.S. Pat. No. 5,905,426, which is a divisional of U.S. patent application Ser. No. 08/670,559, filed on Jun. 27, 1996, now U.S. Pat. No. 5,736,918.

BACKGROUND OF THE INVENTION

The present invention relates to fuses in general, and particularly to current-limiting, time-delay fuses.

A current-limiting time delay fuse 10 employs a built-in delay that allows temporary and harmless inrush currents to pass without the fuse being opened, but which is designed to open in response to a sustained overload and short circuit currents. Such a dual-element fuse is used in circuits subjected to temporary inrush current transients, such as motor starting currents, to provide both high performance short-circuit current protection and time-delay overload current protection.

One conventional type of such a fuse 10, depicted in FIG. 1, comprises a body which includes an electrically insulative tube 12 formed for example of glass reinforced polyester, a pair of copper knife blade terminals 14 connected to respective brass end plates 16, and a pair of steel end caps or ferrules 18. The end caps 18 are attached to the tube 12 by screws 20 (or rivets) to close the ends of the tube and retain the end plates 16. Each terminal 14 projects through a slit 24 formed in a radial portion 15 of a respective end cap 18, and is supported or attached to the tube 12 by a flat pin or roll pin (not shown) extending through the terminal.

Alternatively, as shown in FIGS. 2 and 3, the terminals 14A could be brazed to thick end bells 16A which are inserted into respective ends of the tube 12A such that radial holes 26A formed in each end bell 16A become aligned with respective radial holes 28A formed in the tube 12A. Cylindrical drive pins 30A would be force-fit through respective pairs of holes 26A, 28A to secure the end bells to the tube.

Disposed within a cavity 32 formed by the tube 12 are fuse elements. Preferably, two types of fuse elements 34, 36 are provided, namely, an overcurrent trigger mechanism 34 and a short circuit interrupting fusible element 36. There is at least one of each type of fuse element. The cavity 32 is filled with an arc-quenching filler material 33 such as quartz sand.

Each overcurrent trigger mechanism 34 includes an alloy solder 38 for series-connecting the mechanism 34 to one of the fuse elements 36, a trigger 40, a coil compression spring 42 surrounding the trigger 40, an absorber 44 surrounding the spring 42, a heater element 46, and an insulator 48. The trigger mechanism 34 utilizes stored energy of the spring 42 to break the current in the event of low level overcurrents or overloads, and will hold an overload that is five times greater than the ampere rating of the fuse for a minimum time, e.g., about ten seconds.

Each short circuit fuse element 36 comprises a strip 50 of fusible metal, such as silver, copper, copper alloy, etc., having parallel rows 52 of perforations. Adjacently disposed perforations define therebetween current-carrying weak spots of substantially reduced cross-section designed to break in response to a short circuit overload current.

Although such fuses have performed acceptably, certain shortcomings exist. For instance, in the short circuit fuse elements 36, the strips 50 are supported only by their weak spots which provide very little strength for the fuse element while being handled during the fuse-manufacturing process. Consequently, the fuse elements 36 are susceptible to mechanical fatigue and breakage due to normal handling during manufacture, as well as due to mechanical and thermal fatigue caused by steady state and transient current load current cycling.

Heretofore, the fatigue problem due to handling has been solved by the use of special equipment, tool fixturing and procedures designed to reduce the amount of worker handling. Those measures, however, increase capital expenditures and slow the production rate.

Another shortcoming relating to a time delay current-limiting fuse, or to fuses in general, which are filled with an arc-quenching filler involves the need to plug a hole in which the filler has been introduced. In that regard, the filler is typically introduced through a hole which must be plugged or sealed, in order to retain the filler. A variety of methods of sealing or plugging have been used, such as metal drive plugs, set screws, steel balls, and metal cups, as well as adhesives and glues such as epoxy, but all suffer from various limitations. For example, drive plugs require costly fabrication machinery, set screws are also costly in that they require that the filler hole be machined to form a screw thread; balls and cups are held in place by an interference-fit and are less costly, but the interference-fit is not always reliable, whereby the balls or cups may become dislodged; adhesives are messy to apply and hard to control.

Additional shortcomings may result from the ability to provide the tubes of fuses with shorter lengths. If a fuse manufacturer is to incorporate shorter fuse tube lengths, then certain spacing requirements must be satisfied to ensure that a user can safely grip a fuse without simultaneously touching parts of the fuse which will produce an electrical shock. These spacing requirements are spelled out in the Underwriters Laboratory standards for electrical equipment that use these fuses in a covered device (i.e., disconnect switch). The spacing requirements specifically pertain to what is known as phase-to-phase and phase-to-ground distances between live and/or dead metal parts. A live metal part means a metal conductor at some voltage potential with respect to ground. A dead metal part means a metal conductor at no voltage potential with respect to ground.

In that regard, a common problem involving the application of shorter fuse tube lengths to a typical fuse design is that the longitudinal space between the live metal end caps is so short as to create spacing violations for phase-to-phase and phase-to-ground distances in existing equipment designed to specific Underwriters Laboratory standards. To overcome this spacing violation, several design approaches have been considered. One approach involved the use of heat shrink plastic wrap over the metal end caps, and another approach employed plastic end caps (e.g., see Swain U.S. Pat. No. 2,863,967). Both of those approaches proved either too expensive or impractical due to strength issues.

Yet another shortcoming involving the manufacture of shorter fuses is that in order to make the fuse body shorter the fuse blades must become longer to continue satisfying the dimensional requirements of the fuse. By making the fuse blades longer, a greater mechanical moment may be imposed during installation of the fuse. To accommodate this greater mechanical moment, a stronger mechanical system must be provided. The typical knife blade fuse depicted in FIG. 1 does not provide the necessary mechanical system to support the force exerted on the longer blade of a short-body fuse. The fuse depicted in FIGS. 2 and 3, however, will support this force because of the added strength from the pinned mechanical system to the high strength tube. However, the cost of the pinned mechanical system is too high in cost to implement for all types of fuses, because it uses a very expensive tube material (e.g., glass melamine) and the fuse must be assembled on a C-shaped metal frame which is very labor intensive.

Therefore, it would be desirable to provide a fuse of the type containing an arc-quenching filler with a more effective fill-hole plugging arrangement.

It would also be desirable to provide a short-circuit fuse element which is less susceptible to mechanical and thermal fatigue due to handling as well as due to steady state and transient load current cycling.

It would also be desirable to provide a fuse which provides for strong reinforcement and closure of the ends of the fuse tube while ensuring that ample phase-to-phase and phase-to-ground distances are created.

SUMMARY

In accordance with the present invention, a fuse element comprises a body of metallic material including at least first and second parallel, superimposed strips, each strip including parallel rows of perforations dividing the strip into respective sections, adjacent perforations of each row being spaced apart to define weak points therebetween which secure adjacent ones of the sections together; a plurality of support bridges interconnecting adjacent edges of the first and second strips; each support bridge connecting one of the sections of the first strip to one of the sections of the second strip.

BRIEF DESCRIPTION OF THE DRAWINGS

The objects and advantages of the invention will become apparent from the following detailed description of preferred embodiments thereof in connection with the accompanying drawing in which like numerals designate like elements, and in which.

DETAILED DESCRIPTION OF PREFERRED EMBODIMENTS OF THE INVENTION

Figure 1:
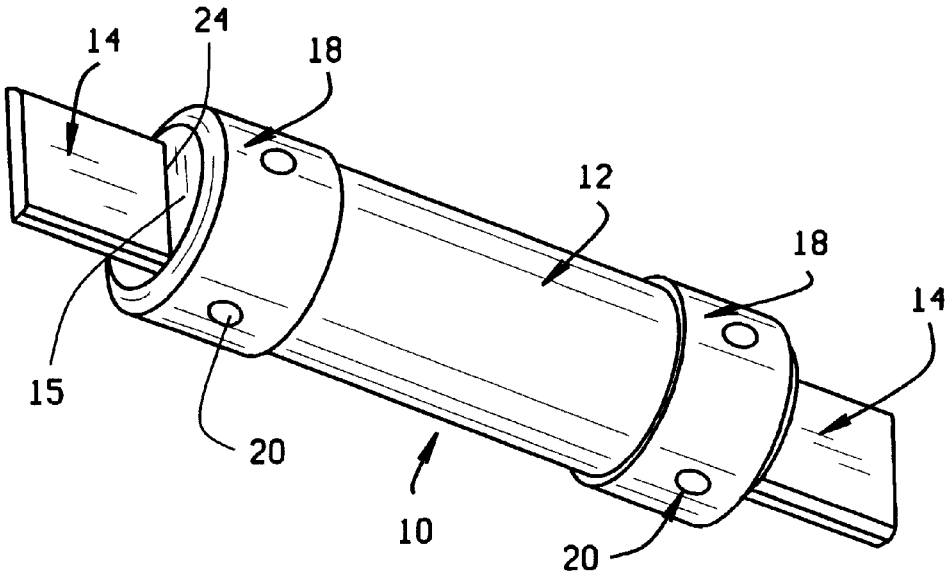
FIG. 1 PRIOR ART
FIG. 1 is a perspective view of a prior art knife blade fuse.
Figure 2:
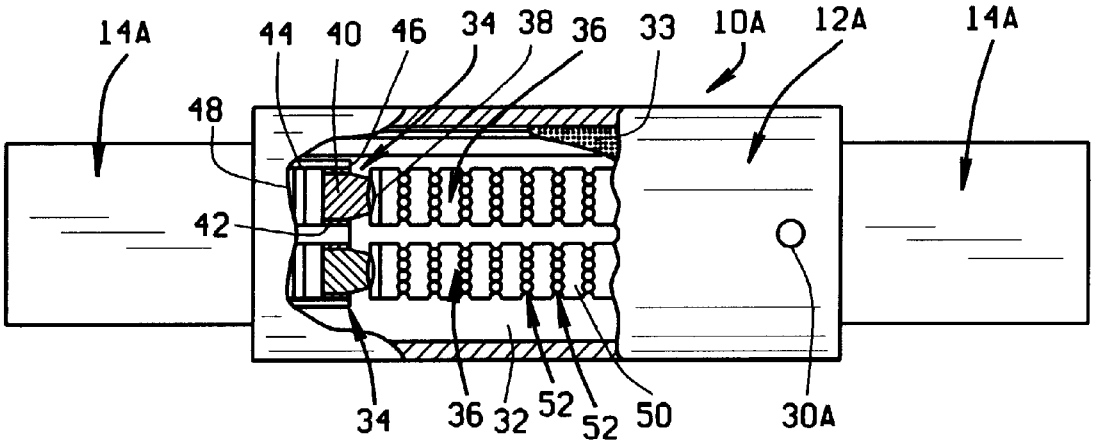
FIG. 2 PRIOR ART
FIG. 2 is a side elevational view of another prior knife blade fuse, with a portion thereof broken away.
Figure 3:
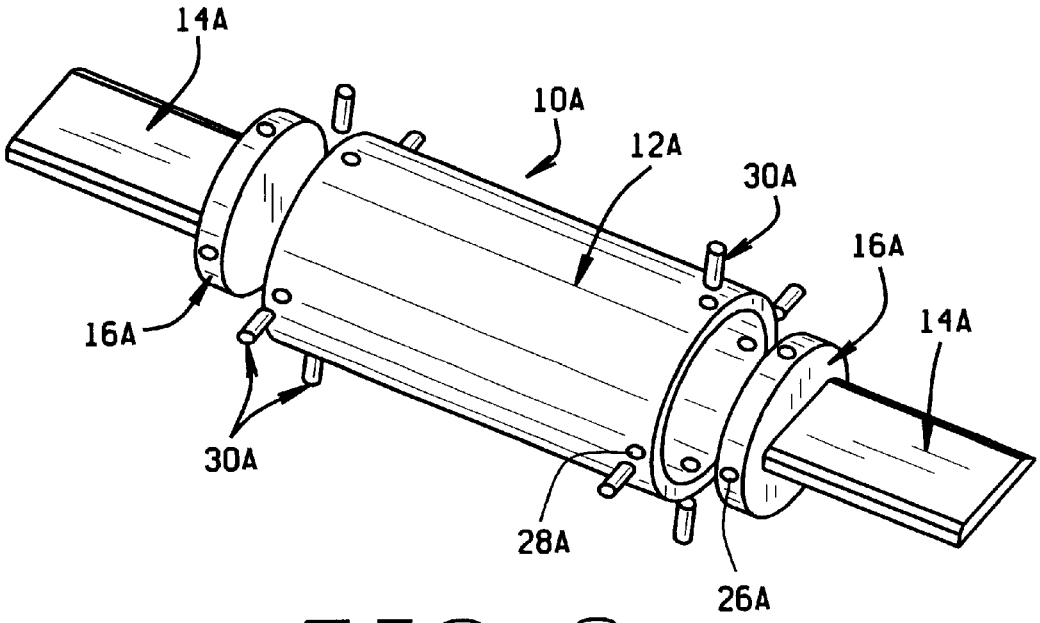
FIG. 3 PRIOR ART
FIG. 3 is an exploded perspective view of the prior art knife blade fuse depicted in FIG. 2.
Figure 4:
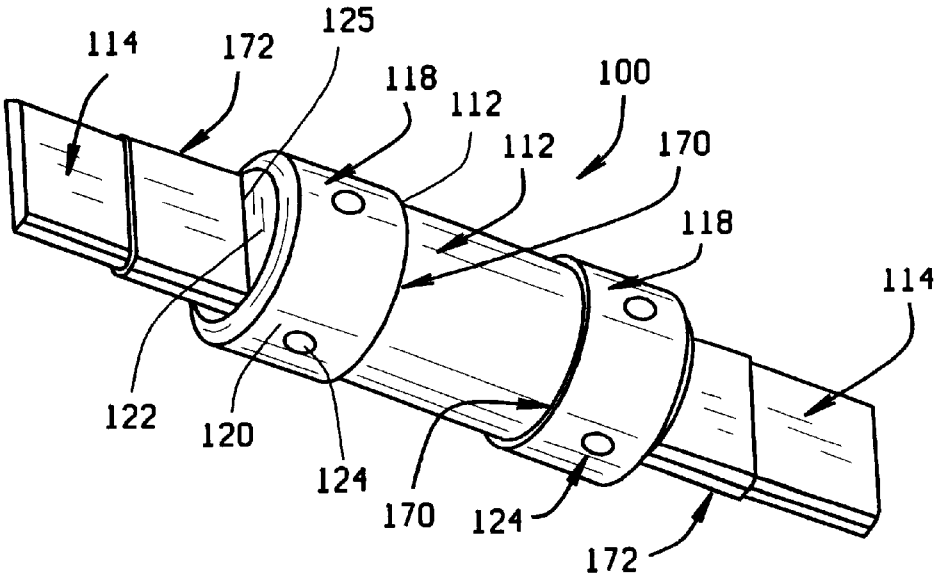
FIG. 4 is a perspective view of a knife blade fuse according to the present invention.

A fuse 100 comprises an electrically insulative cylindrical tube 112 formed for example of glass reinforced polyester, a pair of metallic (e.g., copper) knife blade terminals 114 connected to respective metallic (e.g., brass) end plates 116, and a pair of metallic (e.g., steel) end caps or ferrules 118. Each of the end caps 118 includes a cylindrical portion 120 telescopingly arranged around an outer surface of the tube, and a radial portion 122 extending radially inwardly from an axially outer end of its respective cylindrical portion 120. The end caps 118 are secured to the tube by forming conical indents or dimples 124 in the cylindrical portions 120 which create an interference fit with the outer surface of the tube 112. The blade terminals 114 pass through slits 125 formed in the radial portions 122 of respective end caps.

Short Circuit Fuse Elements

Disposed within a cavity 132 formed by the tube 112 are fuse elements. Preferably two types of fuse elements 34, 136 are provided, namely, an overcurrent trigger mechanism 34 such as the conventional mechanism 34 described earlier herein, and a short circuit interrupting fusible element 136 according to the present invention. There is at least one of each type of fuse element 34, 136. If a plurality of each type of fuse element is employed, such plurality shall preferably be an even number, e.g., two, four, six, etc. The cavity 132 is filled with an arc-quenching filler material 133, such as quartz sand.

As described earlier herein, each overcurrent trigger mechanism 34 utilizes the stored energy of a spring to break the circuit in the event of low level overcurrents or overloads, and will hold an overload that is five times greater than the ampere rating of the fuse for a minimum time, e.g., about ten seconds.

Figure 7:
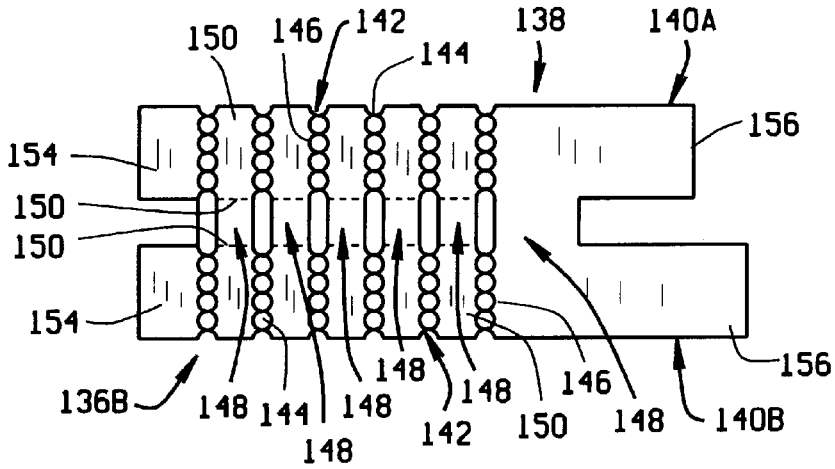
FIG. 7 is a plan view of a blank used to make a fuse element according to the present invention.
Figure 8:
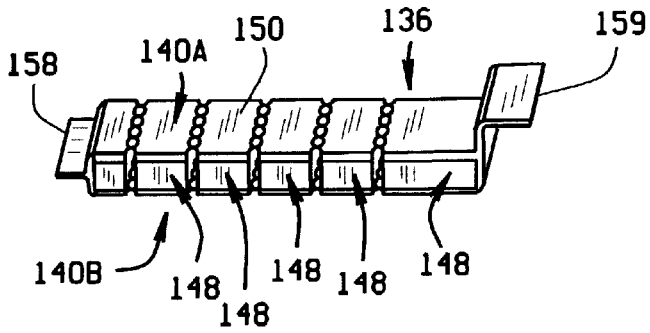
FIG. 8 is a perspective view of the fuse element formed by the blank of FIG. 7.

Each short circuit fuse element 136, which is also depicted in FIG. 8, is formed from a metallic (e.g., silver, copper, copper alloy, etc.) blank 138 depicted in FIG. 7. That blank 138 comprises a pair of strips 140A, 140B each having parallel rows 142 of perforations 144. Formed between adjacently disposed perforations 144 are current-carrying weak spots 146 of substantially reduced cross section designed to break in response to a short circuit overload current.

The two strips 140A, 140B are interconnected by support bridges 148, each support bridge being joined to an edge of a strip 140A or 140B along a region 150 thereof disposed between adjacent rows 142 of perforations. The support bridges 148 are non-interconnected. To form the blank 136B into a fuse element 136, the strips 140A, 140B are folded along parallel fold lines 152 defined by the juncture of the support bridges and strips, whereupon the strips become arranged in spaced apart, superimposed relationship, with the support bridges 148 oriented perpendicular to the strips. Also, the end-most sections 154, 156 of the strips are bent and joined to one another by spot welding, soldering, etc., to form connecting tabs 158, 159. The tab 158 is joined by solder 38 to a trigger 40 of a respective overcurrent trigger mechanism 34. The other tab 159 is joined in a suitable fashion to a respective end plate 116.

Because of the presence of the support bridges 148, and the interconnected end sections 154, 154 and 156, 156, which provide mechanical strength to the adjacent strips 140A, 140B, the strips are no longer supported solely by their weak spots and thus are less susceptible to breakage while being handled. Furthermore, the joining of the end sections to form connecting tabs 158, 159 serves as a convenient means to secure the blank in its folded, fuse-forming state. Moreover, when the fuse element 136 is connected in an electrical circuit and conducts current, the support bridges 148 (since they are non-interconnected) produce an equal distribution of current densities to each of the parallel current paths defined by the weak spots and thereby increase the current capacity for increased time-delay characteristics. Such increased time-delay characteristics, combined with an enhanced heat transfer area contributed by the support bridges, allow for a minimal cross-sectional area of the weak spot region to exist for the purpose of reducing the short-circuit $I^2t$ and peak let-through current $I_p$ to satisfy the UL requirements for maximum allowable $I^2t$ and $I_p$ for a particular class of fuse.

Figure 9:
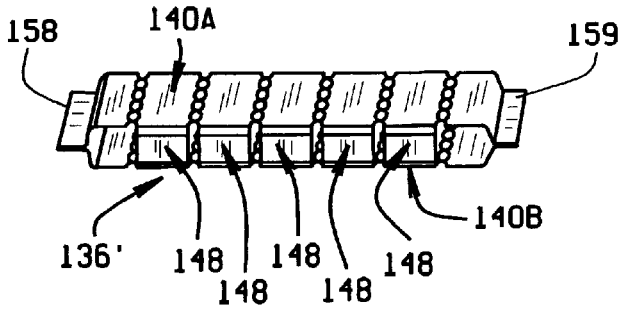
FIG. 9 is a perspective view of a modified fuse element according to the present invention.

The short circuit fuse element can assume different configurations other than that shown in FIG. 8. For example, the end sections 156 could be equal in length to the other end sections 154 and folded to form identical connecting tabs 158, 159' as shown in the fuse element 136' depicted in FIG. 9.

Figure 10:
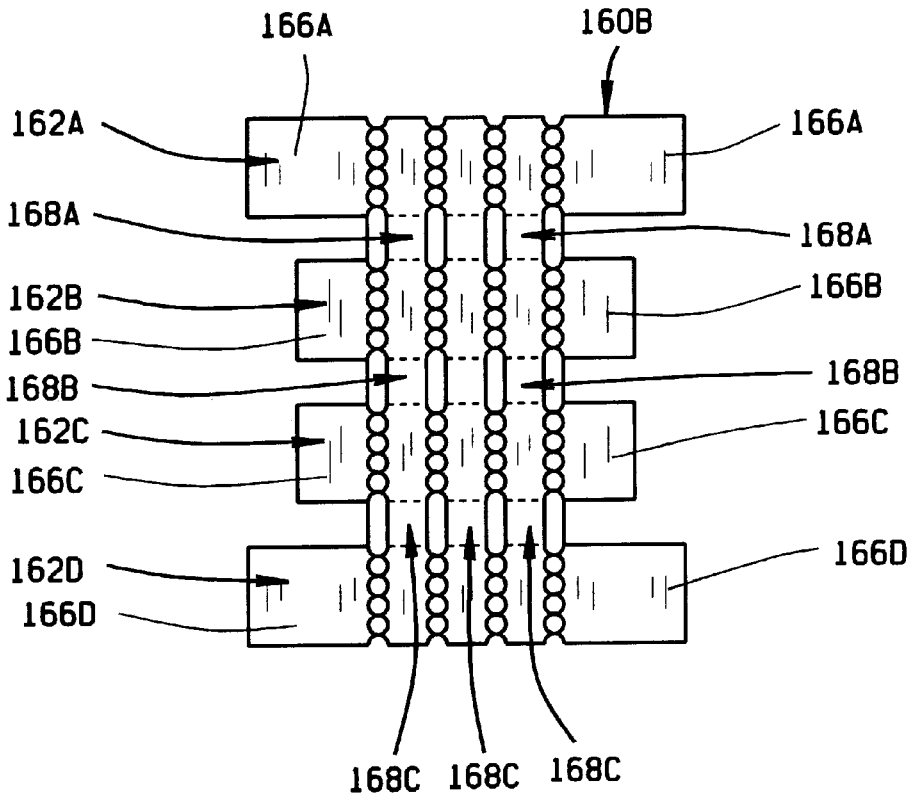
FIG. 10 is a plan view of a blank used to make yet another type of fuse element according to the present invention.
Figure 11:
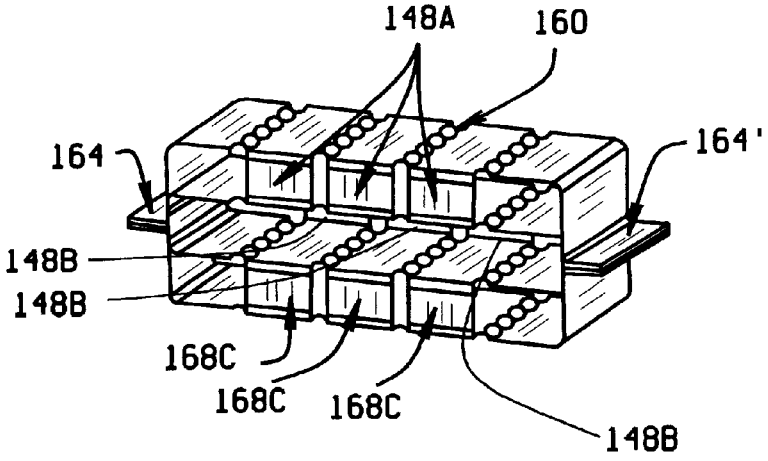
FIG. 11 is a perspective view of the fuse element formed by the blank of FIG. 10.

FIG. 10 illustrates a blank 160B for forming a short-circuit fuse element 160 depicted in FIG. 11. That fuse element 160 is similar to that of FIG. 9, with the principal differences being that four strips 162A–D are provided, instead of two strips, and each connecting tab 164, 164' is formed by interconnecting four end sections 166A–D instead of two end sections. As in the case of FIGS. 8 and 9, the strips of each adjacent pair of strips 162A–D are interconnected by support bridges 168A–C situated along only one edge of a respective strip, and the support bridges are noninterconnected. To form the fuse element 160, the blank 160B is bent into an S-shape, whereby the support bridges 168A and 168C are situated on one side of the fuse element 160, and the support bridges 168B are situated on the opposite side.

The fuse element 160 exhibits the same advantages relating to improved mechanical strength, current density distribution, and heat dissipation exhibited by the fuse elements 136 and 136'.

Figure 23A:
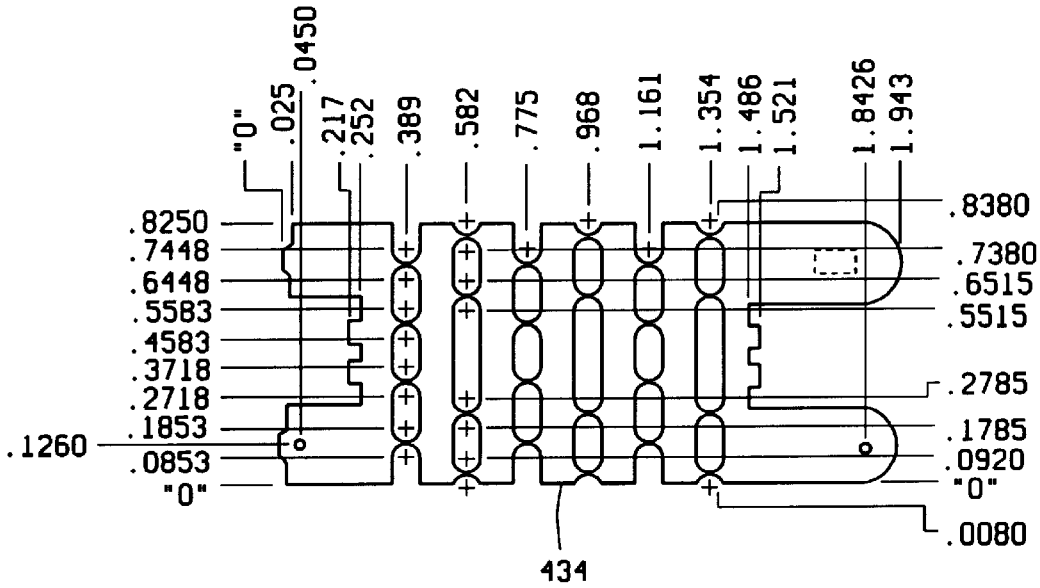
Figure 23B:
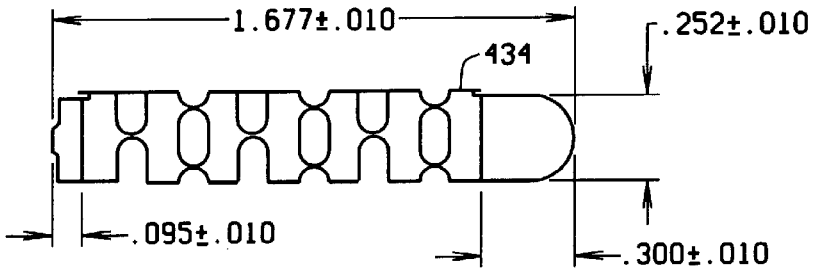
Figure 23C:
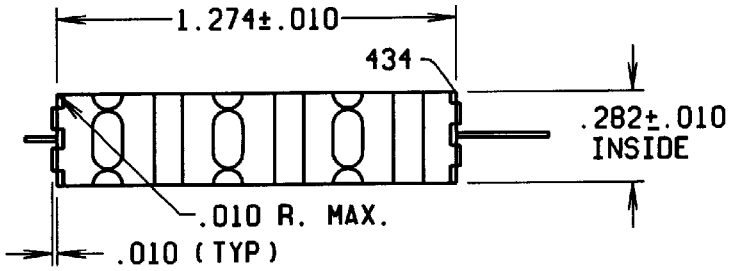
Figure 24A:
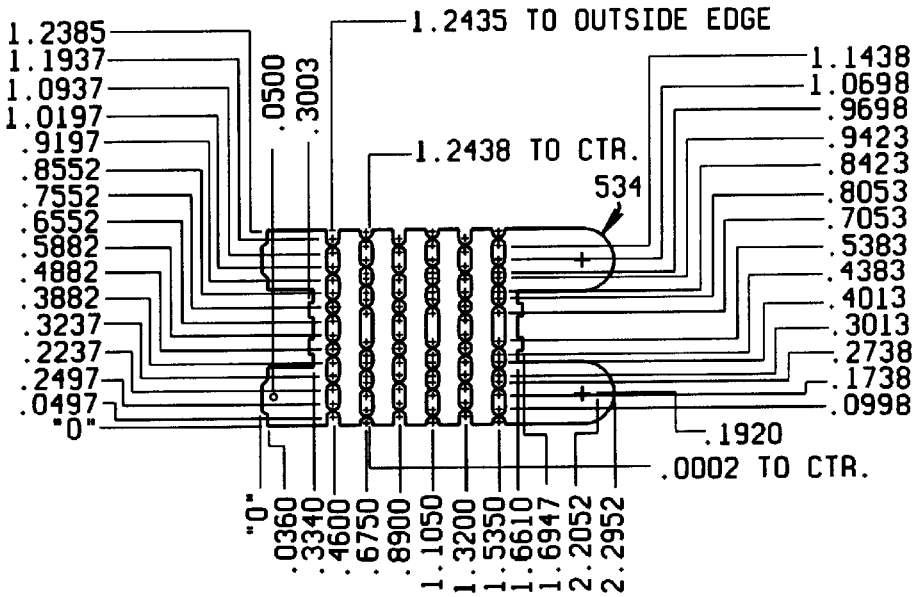
Figure 24B:
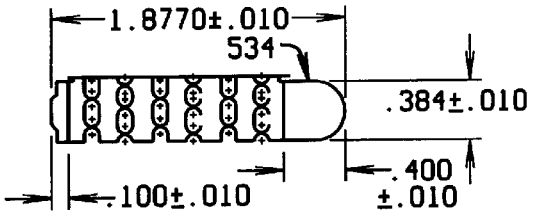
Figure 24C:
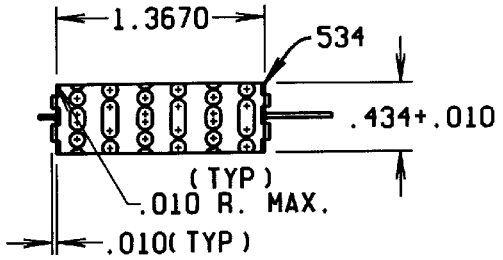

FIGS. 22 through 24 illustrate three alternative embodiments of a short circuit fuse element 334, 434, and 534 that can be used in accordance with the present invention. Elements 334, 434, and 534 are made and function substantially as described above with respect to the first embodiment short circuit element 134.

End Cap Insulation

Figure 12:
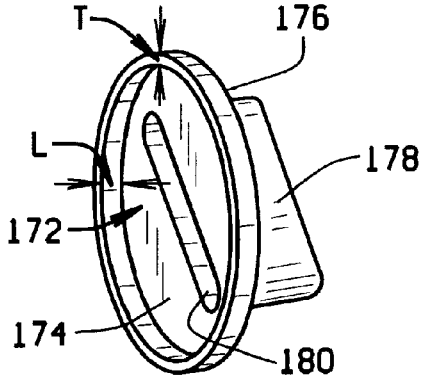
FIG. 12 is a perspective view of one end of an electrically insulative element according to the present invention.
Figure 13:
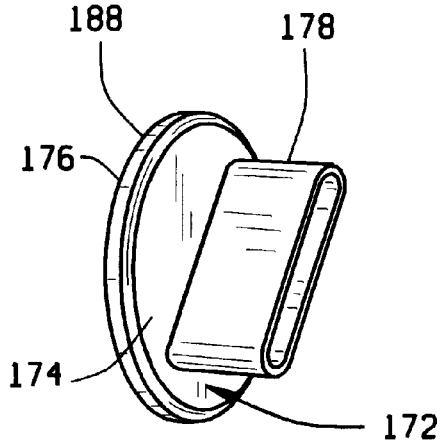
FIG. 13 is a perspective view of the other end of the element depicted in FIG. 12.

As observed earlier, the end caps 118 are formed of metal to provide suitable reinforcement and strength in securing the end plates 116 to the tube 112. It will be appreciated, however, that the mutually adjacent inner ends 170 of the end caps constitute the most closely arranged external metallic pieces of the fuse 100. Hence, in the case when the end caps are electrically connected to the terminals 114 or end plates 116, there exists a risk to a user if his fingers bridge both end caps. That risk becomes greater if a relatively short tube 112 is used. In the present invention, however, that risk is completely eliminated, regardless of the length of the tube 112, by the provision of insulating elements 172 for respective end caps. Since both of the insulating elements 172 are the same, only one will be explained in detail. With reference to FIGS. 12 and 13, each one-piece insulating element 172 includes a radial washer 174, a cylindrical axial flange 176 projecting from an outer peripheral edge of the radial washer 174, and a hollow sleeve 178 projecting axially from a slit 180 formed in the radial washer 174.

Figure 5:
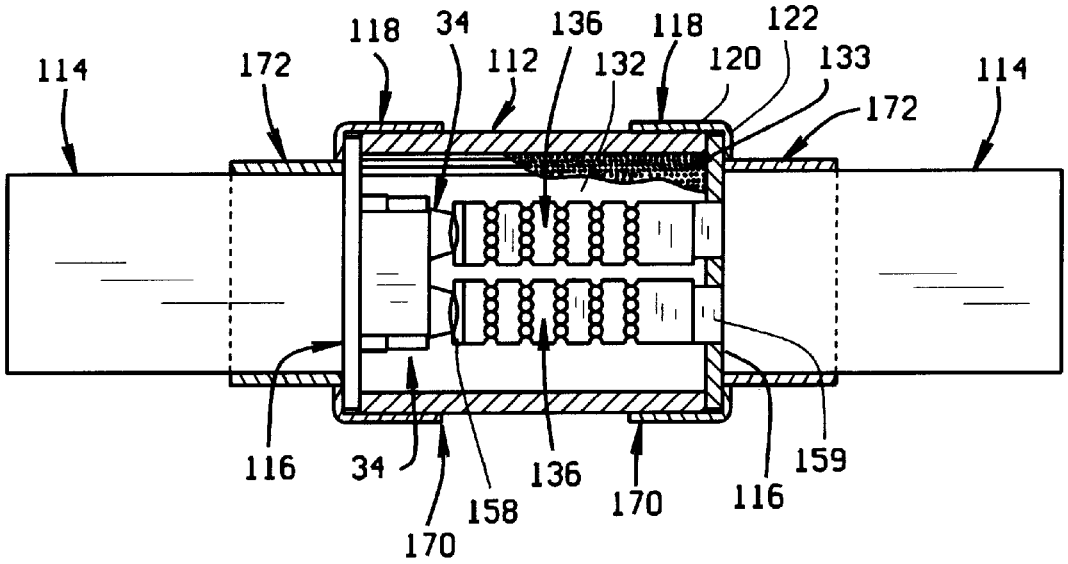
FIG. 5 is a sectional view taken through the fuse of FIG. 4 along a plane extending parallel to blade terminals of the fuse.
Figure 6:
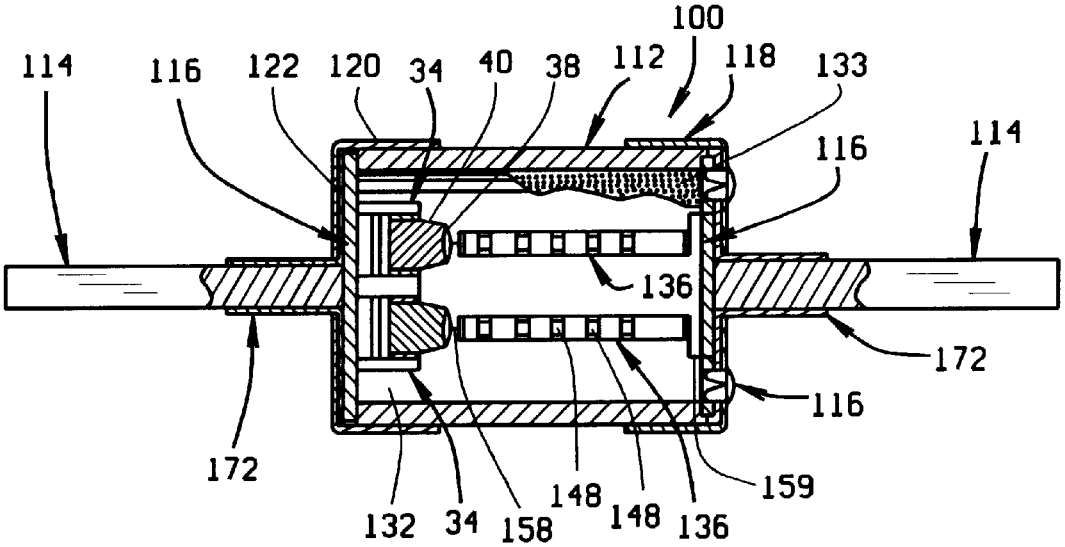
FIG. 6 is a sectional view of FIG. 4 taken along a plane extending perpendicular to the blade terminals.
Figure 20:
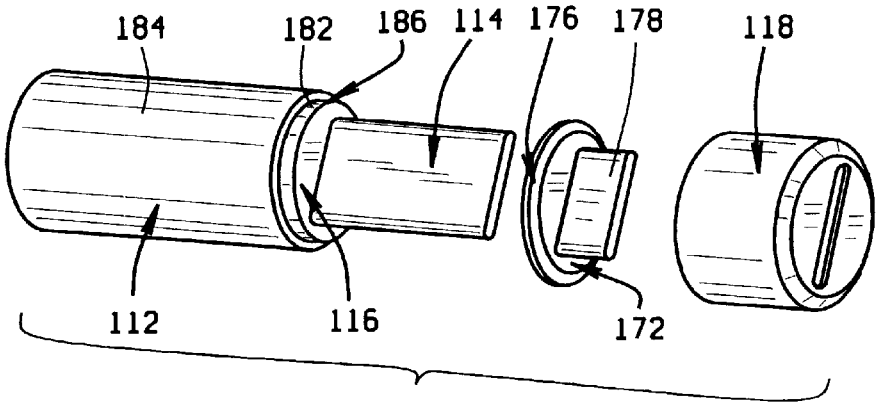
FIG. 20 is an exploded perspective view similar to FIG. 19 after the end plate has been applied against an end of a tube.

With reference to FIG. 20, it can be seen that an outer peripheral edge 182 of the end plate 116 is recessed radially inwardly with respect to an outer periphery 184 of the tube 112 to form an annular recess 186. The dimensions of that recess 186 in the radial and axial directions are the same as the radial thickness T and axial length L of the flange 176 of the insulating element 172 (see FIG. 12). Therefore, when the insulating element 172 is placed against an end of the tube 112, the flange 176 thereof precisely occupies the recess 186, and the outer surface of the flange 176 is flush with the outer surface 184 of the tube 112, as can be seen from FIGS. 5 and 6.

Furthermore, the radial washer 174 of the insulating element 172 overlies the end plate 116, and the terminal 114 extends through the sleeve 178 at the point where the terminal passes through the slit 125 of the end cap 118. It will thus be appreciated that the flange 176 of the insulating element 172 electrically insulates the axial portion 120 of the end cap 118 from the end plate 116; the radial washer 174 electrically insulates the radial portion 122 of the end cap from the end plate 116; and the sleeve 178 electrically insulates the radial portion 122 of the end cap from the terminal 114, and also provides insulation and support along a portion of the length of the terminal.

The insulating element 172 can be formed of any suitable electrically insulative material, such as a glass reinforced thermoplastic molding compound.

Filler Hole Plug

Figure 16:
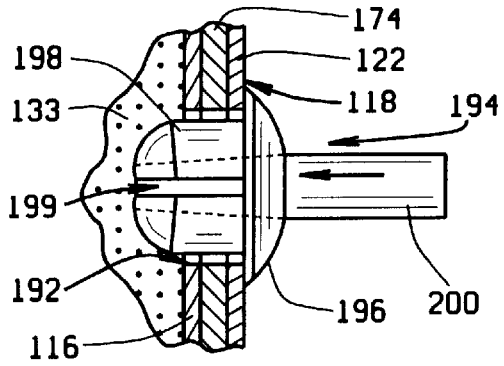
FIG. 16 is a sectional view taken through the end of the fuse depicted in FIG. 4 as a drive rivet is initially inserted into a fill hole.

As explained above, the cavity 132 of the tube 112 is filled with an arc-quenching filler material, such as quartz sand 133. The quartz sand is introduced through one or more filler holes each defined by aligned openings in the radial portion 122 of an end cap 118, the radial washer 174 of the insulating element 172, and the end plate 116, respectively, as shown in FIG. 16.

It becomes necessary to close the filler hole 192 after the quartz sand has been introduced. In accordance with the present invention, the filler hole 192 is closed by a plug formed by a plastic drive rivet 194. Such plastic drive rivets are conventional and are typically used to interconnect parts.

Figure 14:
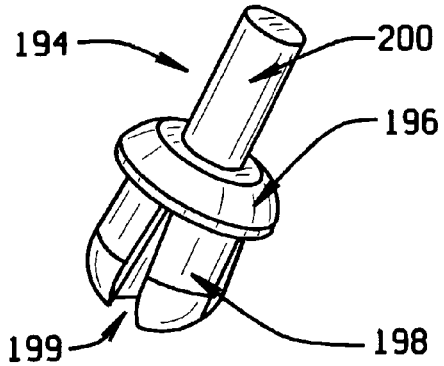
FIG. 14 PRIOR ART
FIG. 14 is a perspective view of a conventional plastic drive rivet.
Figure 15:
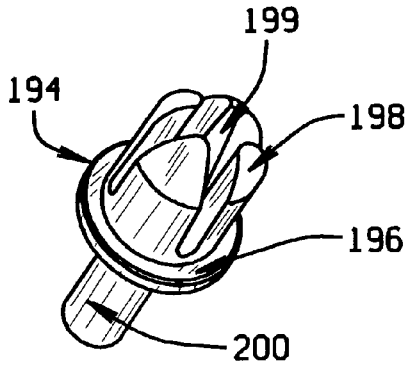
FIG. 15 PRIOR ART
FIG. 15 is another perspective view of the plastic drive rivet depicted in FIG. 14.

The drive rivet 194, depicted in FIGS. 14 and 15, is of one-piece construction and includes a generally frusto-conical flange 196, a plurality of expansion fingers 198 projecting from one side of the flange 196, and a plunger 200 projecting from an opposite side of the flange.

Figure 17:
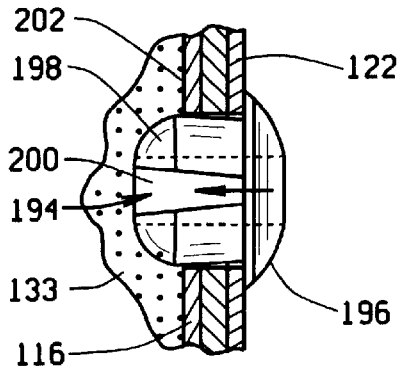
FIG. 17 is a view similar to FIG. 16 after a plunger of the drive rivet has been driven to fixed the drive rivet within the fill hole.

To install the rivet 194 after the cavity 132 has been filled with quartz sand 133, the fingers 198 are inserted axially through the filler hole 192 until the flange 196 abuts the radial portion 122 of the end cap 118 (the flange 196 being of larger diameter than the filler hole). Then, the plunger 200 is driven axially through the flange 196 and into a cavity 199 formed by the fingers 198. The plunger 200 expands the fingers radially outwardly into tight contact with a surface of the filler hole, whereby a maximum diameter formed by the free ends of the fingers is greater than the diameter of the opening of the end plate 116 and is situated inwardly of that opening (i.e., to the left of the opening in FIG. 17).

Accordingly, there results a highly reliable interference fit between the fingers and the inner surface 202 of the end plate 116, preventing dislodgement of the rivet. There thus results a tight and reliable plugging of the filler hole 192 by a relatively inexpensive element.

Furthermore, since the rivet 194 is formed of plastic (i.e., an electrically insulative material) the end cap 118 will not become electrically connected to the end plate 116 as would occur if the filler hole were instead plugged by drive plugs, set screws, balls or cups, which are all typically formed of conductive metal.

Terminal Reinforcement

As explained earlier herein, when a short tube 112 is used in a fuse, the blade terminals 114 must be lengthened in order to continue satisfying the dimensional requirements for the fuse. Lengthening of the terminals means that the terminals will be subject to greater mechanical moments.

Figure 18:
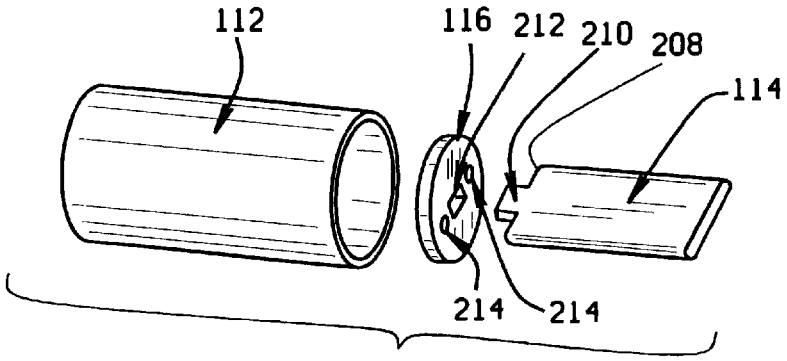
FIG. 18 is an exploded perspective view of an end of the fuse according to the present invention.

The present invention provides additional reinforcement for a portion of the length of the blade terminals by means of the sleeves 178 of the insulating elements 172, as previously mentioned. In addition, an end 208 of each terminal is constructed with an integral staking tang 210 as shown in FIG. 18. Likewise, each end plate 116 is provided with a through-slot 212 sized to receive the staking tang 210.

Figure 19:
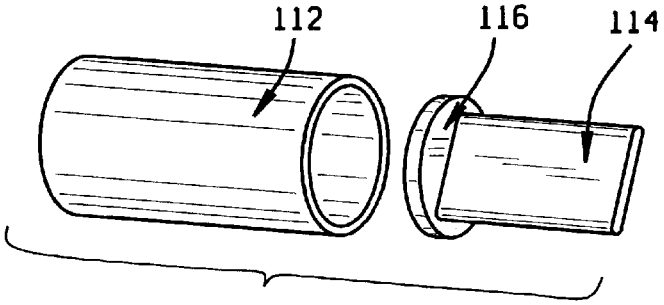
FIG. 19 is a view similar to FIG. 18 after a terminal has been joined to an end plate.
Figure 21:
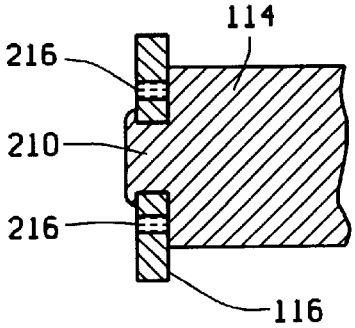
FIG. 21 is a sectional view taken through the end plate and terminal depicted in FIG. 19.
Figure 22A:
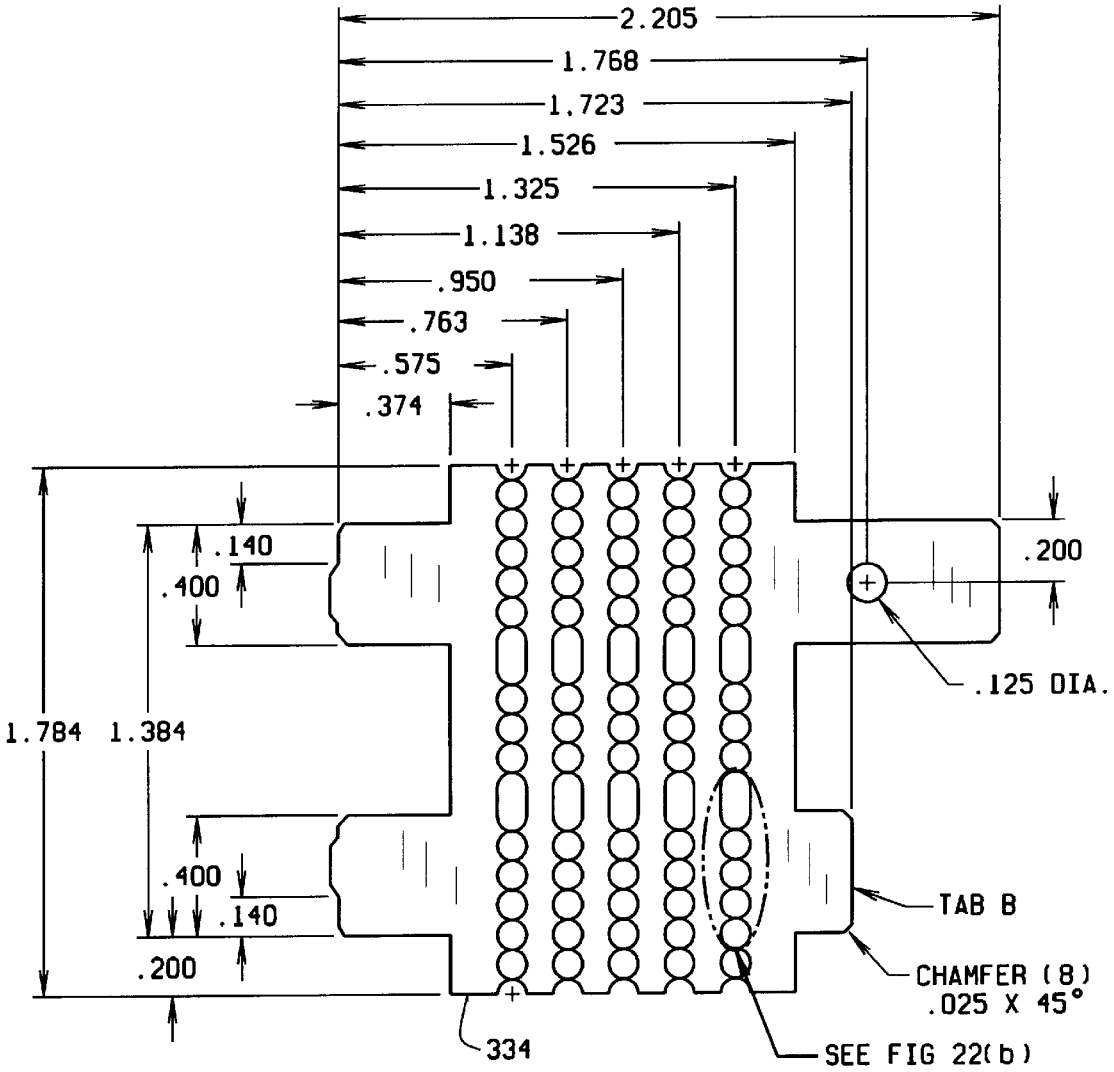
FIGS. 22(*a*)–(*d*), FIGS. 23(*a*)–(*c*), and FIGS. 24(*a*)–(*c*) illustrate alternative embodiments of fuse elements of the present invention.
Figure 22B:
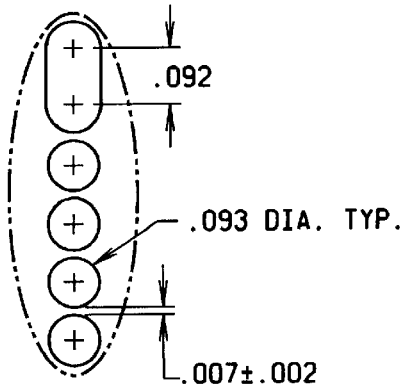
Figure 22C:
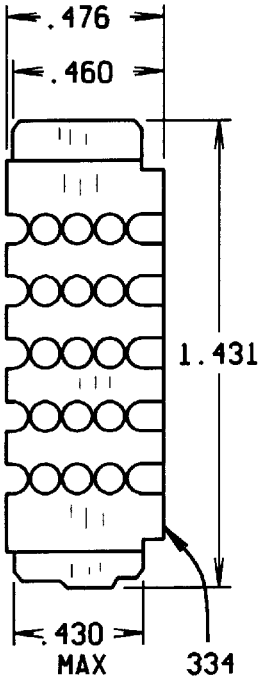
Figure 22D:
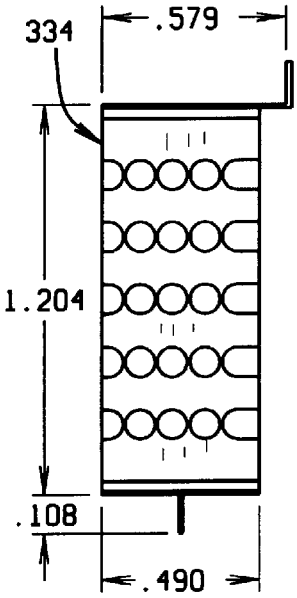

In addition, each end plate 116 is provided with a pair of through-holes 214 arranged on opposite sides of the slot 212 such that the through-holes 214 will be covered by the end 208 of the terminal when the staking tang 210 has been inserted into the slot 212, as shown in FIG. 19. By the application of heat or mechanical force, an inner end of the staking tang becomes deformed, as shown in FIG. 21, thereby staking the terminal to the end plate 116. Also, solder 216 is applied to the through-holes 214 in order to mechanically and electrically couple the terminal to the end plate. The combined support produced by the tang 210, the solder 216, and the sleeve 172, results in an effective strengthening and reinforcing of the blade terminal.

Alternative Embodiments

Figure 25:
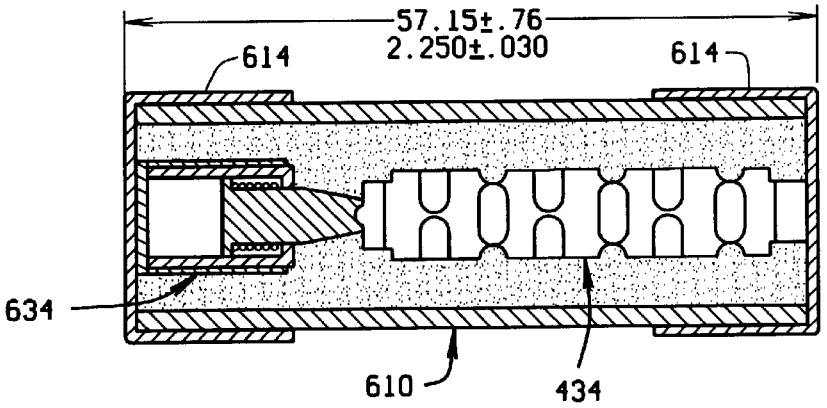
FIGS. 25 and 26 illustrate alternative fuses according to the present invention.

FIG. 25 illustrates a ferrule-type fuse 610 that is similar to the fuse described above, except that it uses ferrules 614 as the electrical contacts, instead of knife blades. The fuse 610 includes a conventional overcurrent trigger mechanism 634 and the short circuit fuse element 434, as disclosed hereinabove.

Figure 26:
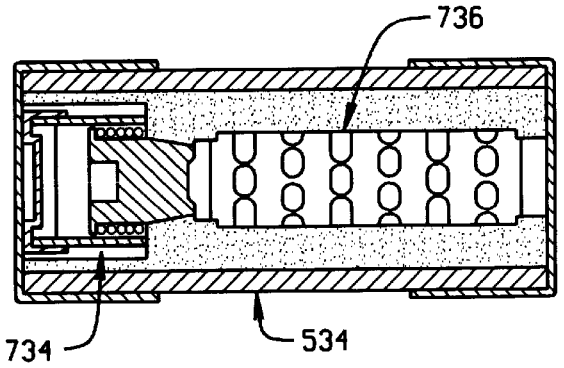

FIG. 26 illustrates another ferrule-type fuse 710 that is similar to the fuses described above, particularly the fuse 610 of FIG. 25. The fuse 710 includes a conventional overcurrent trigger mechanism 734 and the short circuit fuse element 534, as disclosed hereinafter.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A fuse element comprising a body of metallic material including at least first and second parallel, superimposed strips, each strip including parallel rows of perforations dividing the strip into respective sections, adjacent perforations of each row being spaced apart to define weak points therebetween which secure adjacent ones of the sections together; the metallic body further including a plurality of support bridges interconnecting adjacent edges of the first and second strips; each support bridge electrically connecting one of the sections of the first strip to one of the sections of the second strip; adjacent bridges being noninterconnected; and wherein the support bridges are arranged at an angle with respect to the first and second strips.

2. The fuse element according to claim 1, wherein an end-most section of the first strip is fixedly joined to an end-most section of the second strip to define a connecting tab for connecting the fuse element to an electrical circuit.

3. The fuse element according to claim 2, wherein there are four strips.

4. The fuse element according to claim 1, wherein there are four strips.

5. A fuse element comprising a body of metallic material including at least first and second parallel, superimposed strips, each strip including parallel rows of perforations dividing the strip into respective sections, adjacent perforations of each row being spaced apart to define weak points therebetween which secure adjacent ones of the sections together; the metallic body further including a plurality of support bridges interconnecting adjacent edges of the first and second strips; each support bridge electrically connecting one of the sections of the first strip to one of the sections of the second strip; an end-most section of the first strip being fixedly joined to an end-most section of the second strip to define a connecting tab for connecting the fuse element to an electrical circuit; and wherein the support bridges are arranged at an angle with respect to the first and second strips.

6. A fuse element comprising:

a body of metallic material including at least first and second parallel, superimposed strips;

each strip including parallel rows of perforations dividing the strip into respective sections, adjacent perforations of each row being spaced apart to define weak points therebetween which secure adjacent ones of the sections together;

the metallic body further including a plurality of support bridges interconnecting adjacent edges of the first and second strips, each support bridge electrically connecting one of the sections of the first strip to one of the sections of the second strip, adjacent bridges being noninterconnected; and a connecting tab at each end of each of the strips for connecting the fuse element to an electrical circuit.

* * * * *